US006758825B1

(12) United States Patent
Mathew

(10) Patent No.: US 6,758,825 B1
(45) Date of Patent: Jul. 6, 2004

(54) PORTABLE PHYSICAL THERAPY APPARATUS

(76) Inventor: Anthony Mathew, 44 Timberland Cir. North, Fort Meyers, FL (US) 33919

( * ) Notice: Subject to any disclaimer, the term of this patent is extended or adjusted under 35 U.S.C. 154(b) by 118 days.

(21) Appl. No.: 10/163,985

(22) Filed: Jun. 7, 2002

(51) Int. Cl.[7] ..... A61H 1/02; A63B 23/08

(52) U.S. Cl. ..... 601/5; 601/32; 601/33; 482/80

(58) Field of Search ..... 601/5, 27–32, 601/40, 33; 482/80, 79, 908

(56) References Cited

U.S. PATENT DOCUMENTS 3,318,304 A * 5/1967 Gurewich ..... 601/31
3,370,584 A * 2/1968 Girten ..... 601/31
3,580,244 A * 5/1971 Graves ..... 601/31
3,742,940 A * 7/1973 Phiffer ..... 601/26
4,842,265 A * 6/1989 Kirk ..... 601/31
5,203,321 A * 4/1993 Donovan et al. ..... 601/5
5,593,380 A * 1/1997 Bittikofer ..... 601/27
6,010,468 A * 1/2000 Grove et al. ..... 601/23

* cited by examiner

*Primary Examiner*—Danton D. DeMille

(57) ABSTRACT

A portable physical therapy apparatus for providing physical therapy for selected portions of a user's body. The portable physical therapy apparatus includes a support base; and also includes a lever being hingedly attached to the support base and being adapted to support a user's appendage near a user's joint such as a foot; and further includes a plurality of strap members being attached to the lever for fastening the user's appendage to the lever; and also includes an assembly of pivoting the lever upon the support base.

4 Claims, 2 Drawing Sheets

PORTABLE PHYSICAL THERAPY APPARATUS

BACKGROUND OF THE INVENTION

1. Field of the Invention

The present invention relates to portable personal exercisers and more particularly pertains to a new portable physical therapy apparatus for providing physical therapy for selected portions of a user's body.

2. Description of the Prior Art

The use of portable personal exercisers is known in the prior art. More specifically, portable personal exercisers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,211,161; U.S. Pat. No. 5,267,924; U.S. Pat. No. 6,146,341; U.S. Patent No. 5,951,499; U.S. Pat. No. 5,901,581; and U.S. Pat. No. Des. 298,570.

While these devices fulfill their respective, particular objectives and requirements, the aforementioned patents do not disclose a new portable physical therapy apparatus.

SUMMARY OF THE INVENTION

The general purpose of the present invention, which will be described subsequently in greater detail, is to provide a new portable physical therapy apparatus which has many of the advantages of the portable personal exercisers mentioned heretofore and many novel features that result in a new portable physical therapy apparatus which is not anticipated, rendered obvious, suggested, or even implied by any of the prior art portable personal exercisers, either alone or in any combination thereof. The present invention includes a support base; and also includes a lever being hingedly attached to the support base and being adapted to support a user's appendage proximate a user's joint such as a foot; and further includes a plurality of strap members being attached to the lever for fastening the user's appendage to the lever; and also includes an assembly of pivoting the lever upon the support base. None of the prior art includes a platform, a lever, and a linkage member for moving the lever to provide physical therapy to certain selected areas of a user's body and to simulate ambulatory movements thus preventing blood clot formation during one's lack of mobilization.

There has thus been outlined, rather broadly, the more important features of the portable physical therapy apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new portable physical therapy apparatus which has many of the advantages of the portable personal exercisers mentioned heretofore and many novel features that result in a new portable physical therapy apparatus which is not anticipated, rendered obvious, suggested, or even implied by any of the prior art portable personal exercisers, either alone or in any combination thereof.

Still another object of the present invention is to provide a new portable physical therapy apparatus for providing physical therapy for selected portions of a user's body and for simulating ambulatory movements thus preventing blood clot formation during one's lack of mobilization.

Still yet another object of the present invention is to provide a new portable physical therapy apparatus that is easy and convenient to set up anywhere including a foot rest on a wheelchair.

Even still another object of the present invention is to provide a new portable physical therapy apparatus that prevents the deterioration of a user's muscles by working those muscles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
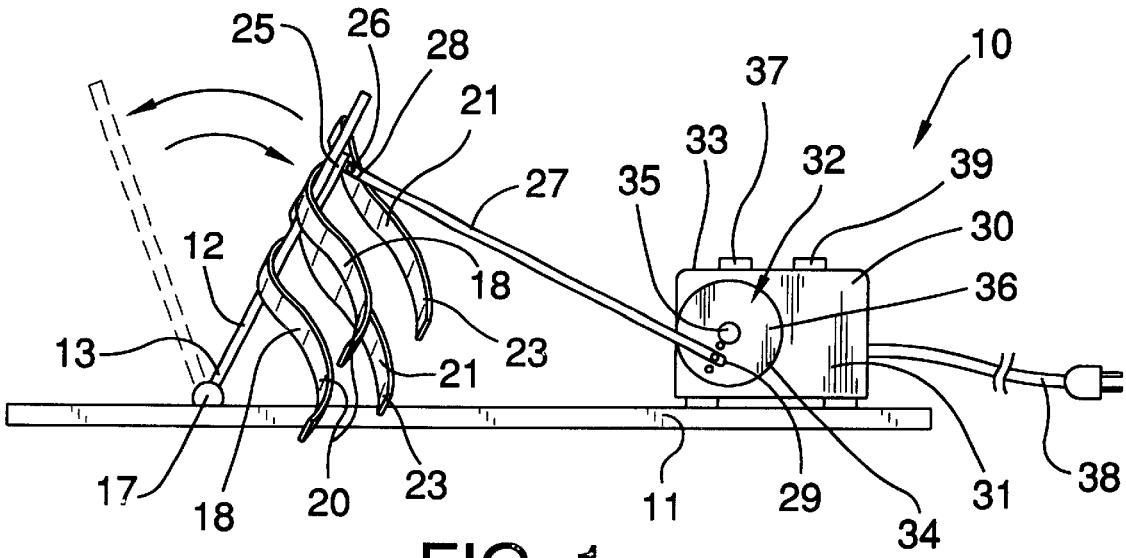
FIG. 1 is a side elevational view of a new portable physical therapy apparatus according to the present invention.
Figure 2:
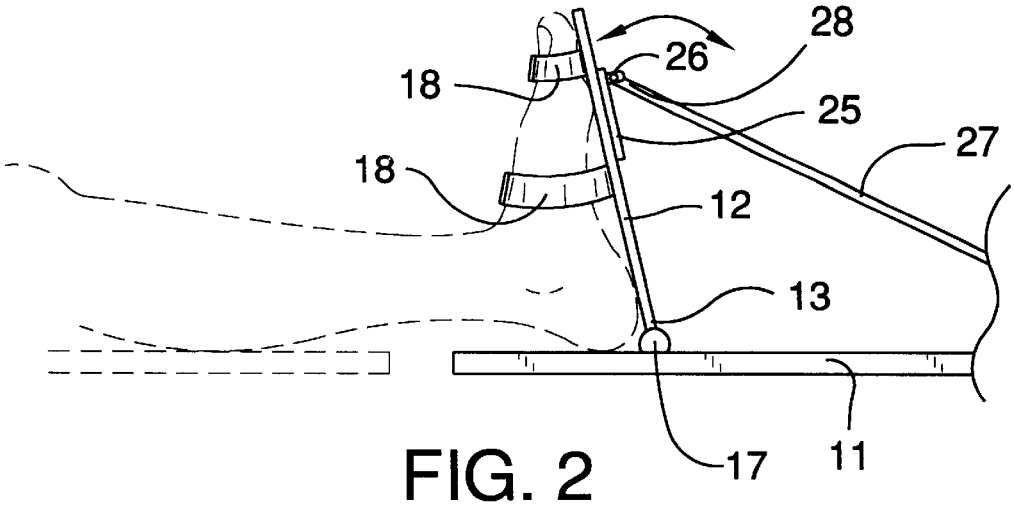
FIG. 2 is a partial side elevational view of the present invention shown in use.
Figure 3:
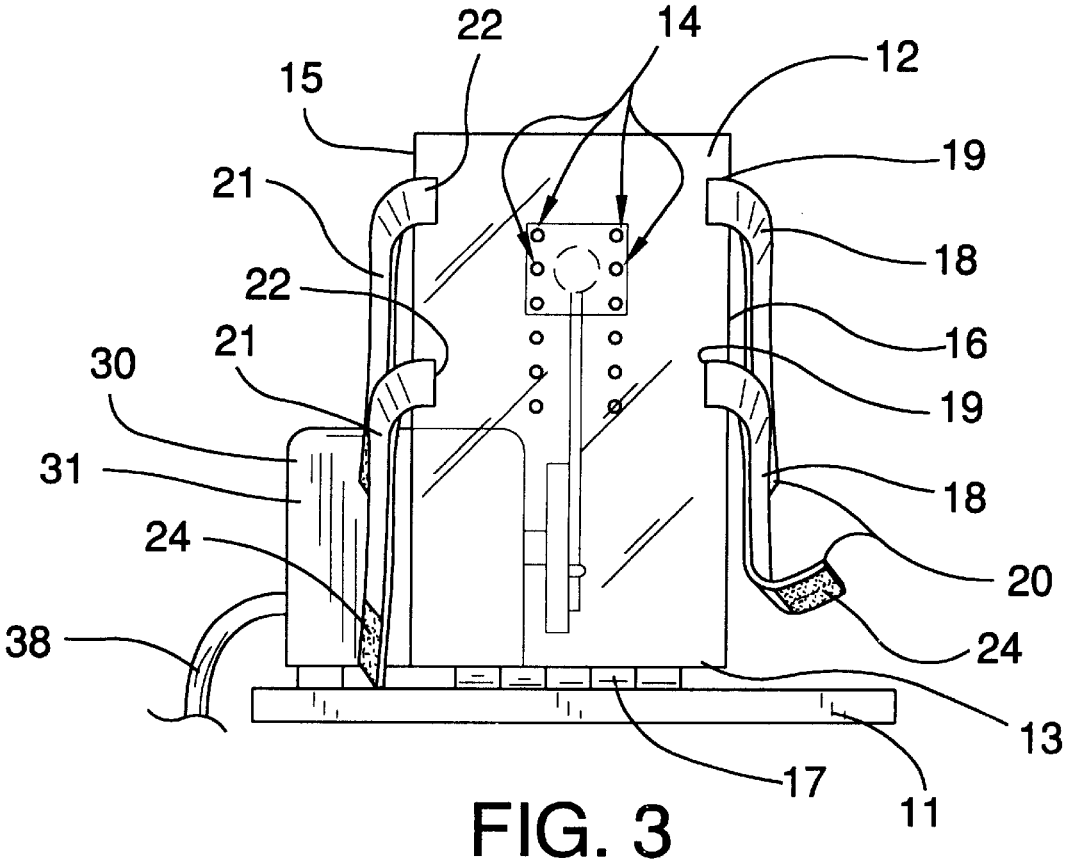
FIG. 3 is a front elevational view of the present invention.
Figure 4:
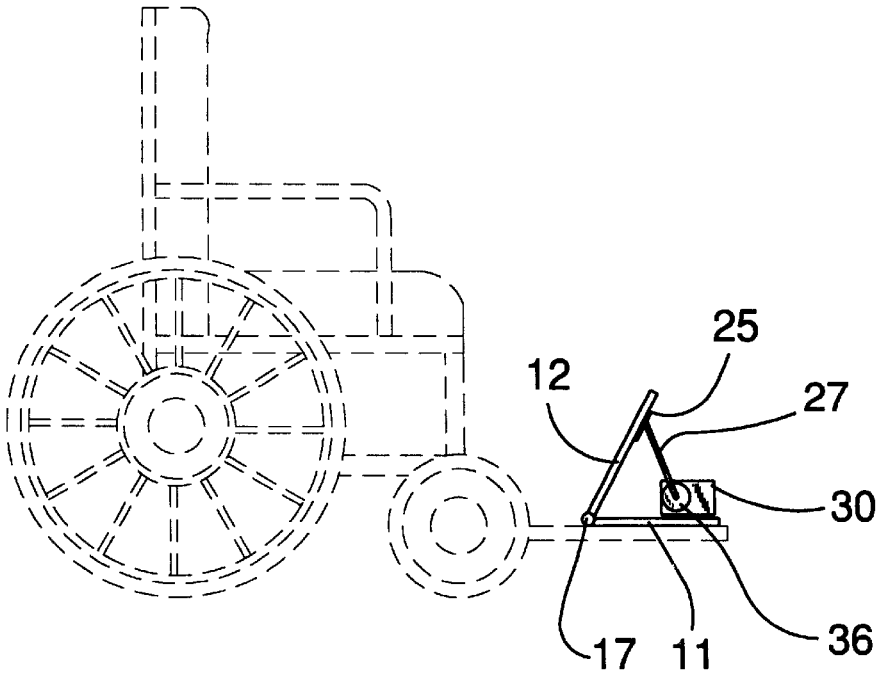
FIG. 4 is another side elevational view of the present invention.

With reference now to the drawings, and in particular to FIGS. 1 through 4 thereof, a new portable physical therapy apparatus embodying the principles and concepts of the present invention and generally designated by the reference numeral 10 will be described.

As best illustrated in FIGS. 1 through 4, the portable physical therapy apparatus 10 generally comprises a support base 11 which is generally a platform which is adapted to be safely aid removably placed upon a surface. A lever 12 is hingedly attached to the support base 11 and is adapted to support a user's appendage proximate a user's joint such as the user's foot. The lever 12 has a bottom edge 13 which is attached with a hinge member 17 to a top side of the support base 11, and has a plurality of holes 14 being disposed therethrough with the holes 14 being spacedly arranged in two columns and being disposed lengthwise of the lever 12.

A plurality of strap members 18–24 are conventionally attached to the lever 12 for fastening a user's appendage to the lever 12. The strap members 18–24 include pairs of straps 18,21 having first ends 19,22 which are securely and conventionally attached along opposed longitudinal edges 15,16 of the lever 12, and also include fastening members 24 such as hook and loop fasteners being securely and conventionally attached and sewn at second ends 20,23 of the straps 18,21 for fastening the pairs of straps 18,21 together about the user's appendage such as the user's foot.

A means of pivoting the lever 12 upon the support base 11 includes a bracket member 25 being adjustably and conventionally fastened with fastener members to a back side of the lever 12 over the holes 14 thereof, and also includes a linkage member having a first end 28 which is pivotally and conventionally attached to a grommet 26 of the bracket member 25, and further includes an actuator being conventionally connected to a second end 29 of the linkage member 27 for moving the lever 12 to and fro. The actuator includes a housing 30 being securely and conventionally mounted upon the top side of the support base 11, and also includes a variable speed motor 34 being conventionally disposed in the housing 30 and having a rotatable shaft 35 conventionally attached thereto, and further includes a linkage support member 36 such as a wheel being conventionally mounted upon the rotatable shaft 35 and to which the second end 29 of the linkage member 27 is pivotally connected, and also includes a power switch 37 being conventionally mounted to the housing 30 and being conventionally connected to the variable speed motor 34 for the energizing thereof, and further includes a power cord 38 being conventionally connected to the power switch 37, and also includes a variable-speed-setting switch 39 being conventionally mounted to the housing 30 and being conventionally connected to the variable speed motor 34 for controlling the speed at which the rotatable shaft 35 rotates. The housing 30 has top and side walls 31,33, and has an opening 32 disposed through one of the side walls 31 with the linkage support member 36 being rotatably disposed in the opening 32 thereof. The second end 29 of the linkage member 27 is pivotally attached between a center of the linkage support member 36 and outer edge of the linkage support member 36 so that the linkage member 27 moves as the linkage support member 36 rotates thus causing the lever 12 to pivot back and forth upon the support base 11.

In use, the user will place and fasten one's appendage upon the lever 12 using the strap members 18–24, and will energize the variable speed motor 34 using the power switch 37 which causes the linkage support member 36 to rotate and the linkage member 27 to move back and forth with the user's appendage such as one's foot moving with the lever 12. The user can adjust the speed at which the lever 12 pivots by manipulating the variable-speed-setting switch 39.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the portable physical therapy apparatus. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable physical therapy apparatus comprising:

a support base, said support base being generally a platform which is adapted to be placed upon a surface;

a lever being hingedly attached to said support base and being adapted to support a user's appendage proximate a user's joint such as the user's foot, said lever having a bottom edge which is attached with a hinge member to a top side of said support base, and having a plurality of holes being disposed therethrough;

a plurality of strap members being attached to said lever for fastening the user's appendage to said lever; and a means of pivoting said lever upon said support base including a bracket member being adjustably fastened with fastener members to a back side of said lever over said holes thereof, and also including a linkage member having a first end which is pivotally attached to a grommet of said bracket member, and further including an actuator being connected to a second end of said linkage member for moving said lever to and fro.

2. A portable physical therapy apparatus as described in claim 1, wherein said actuator includes a housing being securely mounted upon said top side of said support base, and also includes a variable speed motor being disposed in said housing and having a rotatable shaft attached thereto, and further includes a linkage support member being mounted upon said rotatable shaft and to which said second end of said linkage member is pivotally connected, and also includes a power switch being mounted to said housing and being connected to said variable speed motor for the energizing thereof, and further includes a power cord being connected to said power switch, and also includes a variable-speed-setting switch being mounted to said housing and being connected to said variable speed motor for controlling the speed at which said rotatable shaft rotates.

3. A portable physical therapy apparatus as described in claim 2, wherein said housing has top and side walls, and has an opening in one of said side walls, said linkage support member being rotatably disposed in said opening thereof.

4. A portable physical therapy apparatus as described in claim 3, wherein said second end of said linkage member is pivotally attached between a center of said linkage support member and outer edge of said linkage support member so that said linkage member moves as said linkage support member rotates thus causing said lever to pivot back and forth upon said support base.

* * * * *

UNITED STATES PATENT AND TRADEMARK OFFICE

CERTIFICATE OF CORRECTION

PATENT NO. : 6,758,825 B1
APPLICATION NO. : 10/163985
DATED : July 6, 2004
INVENTOR(S) : Antony Mathew It is certified that error appears in the above-identified patent and that said Letters Patent is hereby corrected as shown below:

Title page, item [76] inventor's name should read as follows -- Antony Mathew instead of Anthony Mathew --

Title page, item [76] inventor's address should read as follows -- Fort Myers instead of Fort Meyers --

Signed and Sealed this
Seventeenth Day of December, 2013

Margaret A. Focarino

Margaret A. Focarino
*Commissioner for Patents of the United States Patent and Trademark Office*